US005170513A

United States Patent [19]

Ambooken et al.

[11] Patent Number: 5,170,513

[45] Date of Patent: Dec. 15, 1992

[54] TOILET FLUSHER FOR DISABLED PEOPLE

[76] Inventors: Deepak Ambooken, 102-31 129 St., Richmond Hill, N.Y. 11419; George Spector, 233 Broadway, Rm. 3815, New York, N.Y. 10007

[21] Appl. No.: 657,468

[22] Filed: Feb. 19, 1991

[51] Int. Cl.[5] ..... E03D 5/08

[52] U.S. Cl. ..... 4/249; 251/295

[58] Field of Search ..... 4/249, 250, 251, 411; 251/295

[56] References Cited

U.S. PATENT DOCUMENTS

| | | | |
|---|---|---|---|
| 575,930 | 1/1897 | Morell | 4/249 X |
| 624,176 | 5/1899 | Chisholm | 4/249 X |
| 718,971 | 1/1903 | Becker | 4/249 X |
| 1,134,755 | 4/1915 | Marcuse | 4/251 X |
| 2,204,867 | 6/1940 | Rehback | 4/249 X |
| 2,467,019 | 4/1949 | Farson | 4/249 |
| 2,679,651 | 6/1954 | Pokorny | 4/249 X |
| 2,849,728 | 9/1958 | Gyllenberg | 4/251 |
| 3,095,582 | 7/1963 | Booth | 4/249 |
| 4,868,931 | 9/1989 | Schneeweiss | 4/249 X |
| 5,068,925 | 12/1991 | Salibi | 4/249 |

FOREIGN PATENT DOCUMENTS

| | | | |
|---|---|---|---|
| 0398154 | 7/1924 | Fed. Rep. of Germany | 4/411 |
| 9886691 | 10/1943 | France | 4/249 |

*Primary Examiner*—Henry J. Recla
*Assistant Examiner*—Robert M. Fetsuga

[57] ABSTRACT

A toilet flusher for a disabled person is provided and consists of an elongated cord having a first end connected to a flush handle on a tank of a toilet and a mechanism mounted on the floor next to the toilet and connected to a second end of the cord, for triggering the cord to operate the flush handle when the disabled person steps on the trigger mechanism with their foot instead of with their hand. In a modification an adjustable extension handle is attached to the triggering mechanism so that the disable person can operate the triggering mechanism by pressing down on the extension handle.

1 Claim, 1 Drawing Sheet

TOILET FLUSHER FOR DISABLED PEOPLE

BACKGROUND OF THE INVENTION

The instant invention relates generally to toilets and more specifically it relates to a toilet flusher for disabled people which provides a mechanism to help the disabled people operate the flush handle by stepping on the mechanism.

There are available various conventional toilets which do not provide the novel improvements of the invention herein disclosed.

SUMMARY OF THE INVENTION

A primary object of the present invention is to provide a toilet flusher for disabled people that will overcome the shortcomings of the prior art devices.

Another object is to provide a toilet flusher for disabled people that helps the disabled people, who can't reach the flush handle on the toilet, to flush the toilet by stepping on a mechanism which triggers a wire connected to the flush handle.

An additional object is to provide a toilet flusher for disabled people that are not able to use their hands/arms and other disabled people that have back pain who find it hard to reach behind them to operate the flush handle.

A further object is to provide a toilet flusher for disabled people that is simple and easy to use.

A still further object is to provide a toilet flusher for disabled people that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
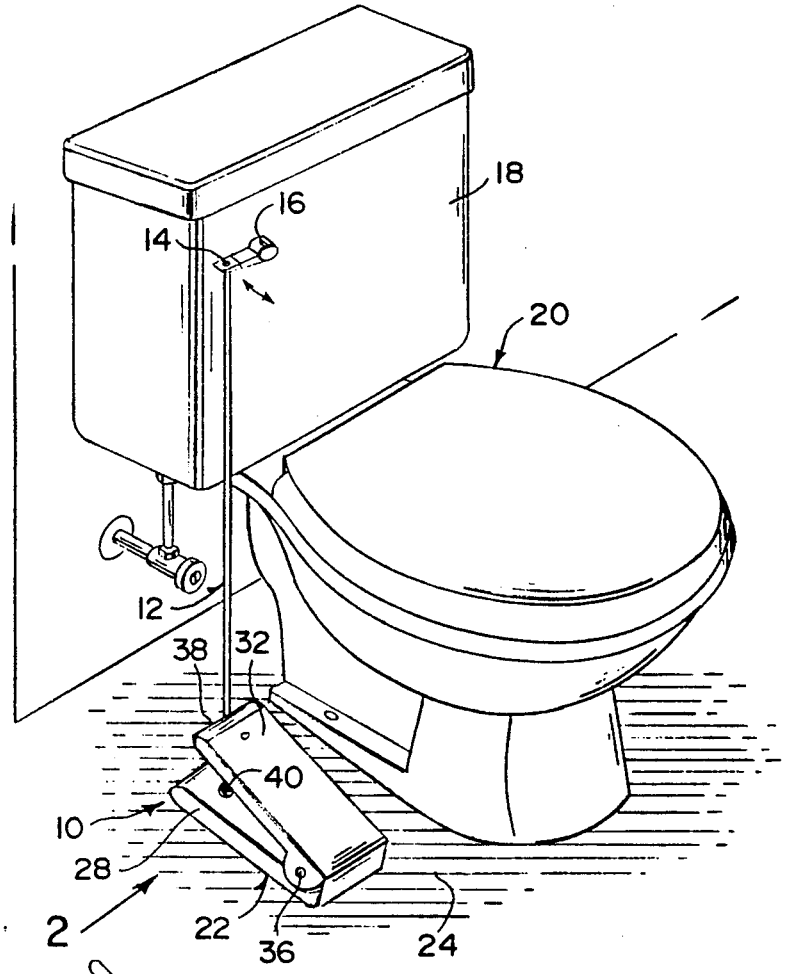
FIG. 1 is a perspective view of the instant invention installed for use with a flush handle of a toilet.
Figure 2:
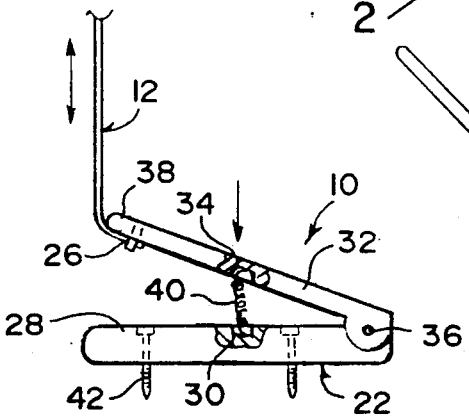
FIG. 2 is a side view taken in direction of arrow 2 in FIG. 1.

Turning now descriptively to the drawings, in which similar reference characters denote similar elements throughout the several views, the Figures illustrate a toilet flusher 10 for a disabled person consisting of an elongated cord 12 having a first end 14 connected to a flush handle 16 on a tank 18 of a toilet 20. A mechanism 22 is mounted on the floor 24 next to the toilet 20 and is connected to a second end 26 of the cord 12, for triggering the cord to operate the flush handle 16, when the disabled person steps on the triggering mechanism 22 with their foot.

The triggering mechanism 22 includes a base member 28 having a recess 30 in a top surface and is placed upon the floor 24 next to the toilet 20. The base member 28 is mounted to the floor 24 so that the base member 28 will be in a stationary position. A platform 32, having a recess 34 in a bottom surface, is hinged at one end 36 to the base member 28 whereby the second end 26 of the cord 12 is connected to a free end 38 of the platform 32. A spring 40 extends between the top recess 30 in the base member 28 and the bottom recess 34 in the platform 32 to bias the platform 32 from the base member, so that the disabled person can step onto the platform 32 and press it downwardly by compressing the spring 40 to trigger the cord 12.

A plurality of fasteners 42, such as nails or screws, extend through the base member 28 and into the floor 24 for mounting the base member 28 in the stationary position.

Figure 3:
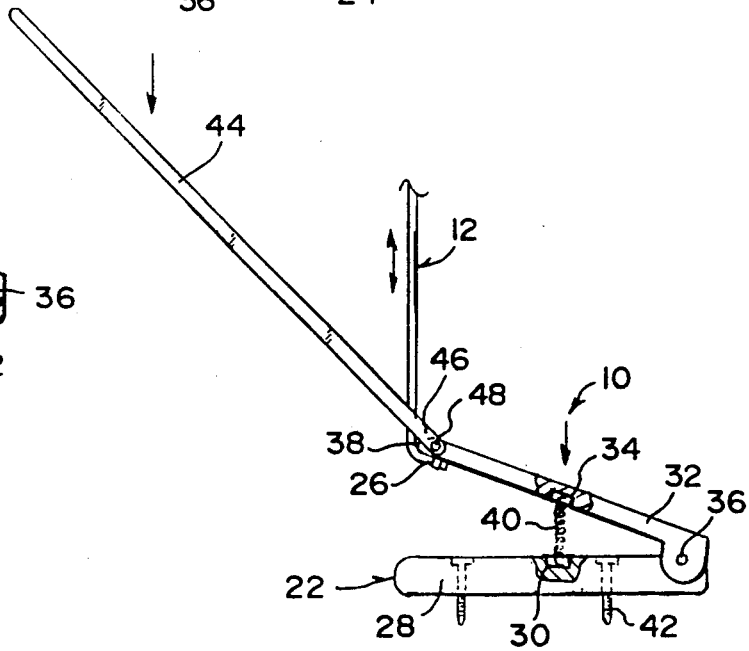
FIG. 3 is a side view similar to FIG. 2 showing a modification having an elongated adjustable arm that can be utilized by disabled people.

The toilet flusher 10 as shown in FIG. 3, further includes an extension handle 44 hinged at one end 46 to the platform 32. A set screw 48 is at the hinged end 46 of the extension handle, when the set screw 48 is tightened it will retain the extension handle 44 in an angular adjusted position. This will allow the disabled person, if having back pain and finding it hard to reach behind to operate the flush handle 16, to press down on the extension handle 44 and the platform 32.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A floor mounted toilet flusher in combination with a toilet tank flush handle for use by a disabled person comprising:

a) an elongated cord having a first end connected to said flush handle;

b) triggering means connected to a second end of said cord, for triggering said cord to operate the flush handle when the disabled person steps on said means with their foot; wherein said triggering means includes:

c) a base member having a recess in a top surface and mountable upon a floor;

d) means for mounting said base member to the floor so that said base member will be in a stationary position;

e) a platform having a recess in a bottom surface and hinged at one end to said base member whereby said second end of said cord is connected to a free end of said platform;

f) a spring mounted in the first said recess and extending into the second said recess engaging said platform to bias said platform away from said base member, so that the disabled person can step onto said platform and press it downwardly by compressing said spring to trigger said cord; wherein said mounting means includes a plurality of fasteners extending through said base member; further including:

g) an extension handle hinged at one end to said platform; and h) a set screw at the hinged end of said extension handle, so that when said set screw is tightened it will retain said extension handle in an angular adjusted position, allowing the disabled person, if having back pain and finding it hard to reach behind to operate the flush handle, to press down on said extension handle and said platform.

* * * * *